US005197255A

United States Patent [19]

Fricker

[11] Patent Number: 5,197,255

[45] Date of Patent: Mar. 30, 1993

[54] ANCHORING DEVICE FOR FASTENING CLADDING PANELS TO A WALL

[75] Inventor: Siegfried Fricker, Heimsheim, Fed. Rep. of Germany

[73] Assignee: Unistrut Europe PLC, Bedford, United Kingdom

[21] Appl. No.: 645,789

[22] Filed: Jan. 25, 1991

[30] Foreign Application Priority Data

Jan. 27, 1990 [DE] Fed. Rep. of Germany ..... 4002420

[51] Int. Cl.[5] ..... E04B 1/38

[52] U.S. Cl. ..... 52/703; 52/698; 52/708; 52/125.6

[58] Field of Search ..... 52/703, 698, 706, 708, 52/713, 714, 125.3, 125.4, 125.5, 125.6

[56] References Cited

U.S. PATENT DOCUMENTS

| | | | |
|---|---|---|---|
| 1,936,772 | 11/1933 | Schurman | 52/706 |
| 3,834,099 | 9/1974 | Haeussler | 52/378 X |
| 3,982,372 | 9/1976 | Haeussler | 52/513 |
| 4,329,826 | 5/1982 | Flogaus et al. | 52/295 X |
| 4,607,472 | 8/1986 | Pointner | 52/698 |

FOREIGN PATENT DOCUMENTS

| | | | |
|---|---|---|---|
| 3411003 | 11/1984 | Fed. Rep. of Germany | 52/698 |
| 2546214 | 5/1983 | France | 52/698 |

*Primary Examiner*—David A. Scherbel
*Assistant Examiner*—Kien Nguyen
*Attorney, Agent, or Firm*—Robert W. Becker & Associates

[57] ABSTRACT

An anchoring device for fastening cladding panels to walls of buildings has a flat band of an essentially rectangular cross-section that is provided with spaced holes arranged one after another in a longitudinal direction. An upper end of the band is connected to a fastening part. A bolt that is inserted into one of the holes fastens the band to a fastening element that is attached to the cladding panel. The fastening element comprises a supporting member and an essentially parallel counter member. The supporting member and the counter member are spaced at a distance over a portion of their respective longitudinal dimension whereby the distance corresponds at least to the thickness of the band. The band is inserted into the space between the supporting member and the counter member. A second of the band is bent directly above the supporting member, whereby the supporting member serves as a bending edge.

29 Claims, 11 Drawing Sheets

ANCHORING DEVICE FOR FASTENING CLADDING PANELS TO A WALL

BACKGROUND OF THE INVENTION

The present invention relates to an anchoring device for fastening cladding panels to walls of buildings whereby the anchoring device comprises a flat band of a rectangular cross-sectional shape that is provided with spaced holes arranged one after another in a longitudinal direction. An upper end of the band is connected to a fastening part with a bolt that is inserted into one of the holes, thereby fastening the band to a fastening element that is to be connected to the cladding panel.

An anchoring device for fastening cladding panels to a fastening surface, for example, a building wall, is known from DE-OS 37 21 452. This device allows for a coarse and a fine adjustment of the desired length of the anchoring device. The coarse adjustment is achieved by providing a perforated band through which a screw is inserted into a fastening element of the cladding panel. A hole or perforation is selected that corresponds to the desired length of the band. After the coarse length of the band is predetermined, the band must be bent in a definite distance above the chosen perforation with the aid of a bending device. Otherwise, the cladding panel will not hang in a vertical position. This bending step is complicated and time consuming. Also, the precision of the bending step depends on the skill of the work man. After the bending has been carried out the anchoring device must be screwed to the cladding panel. It is also disadvantageous that the distances between the respective fastening means in the wall and the fastening positions of the cladding panels must correspond exactly because it is not possible to correct a horizontal deviation.

It is therefore an object of the present invention to improve an anchoring device of the aforementioned kind such that a fast, simple and secure mounting of the anchoring device, including also the bending step of the band, is provided without the need for auxiliary means, for example, bending devices.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
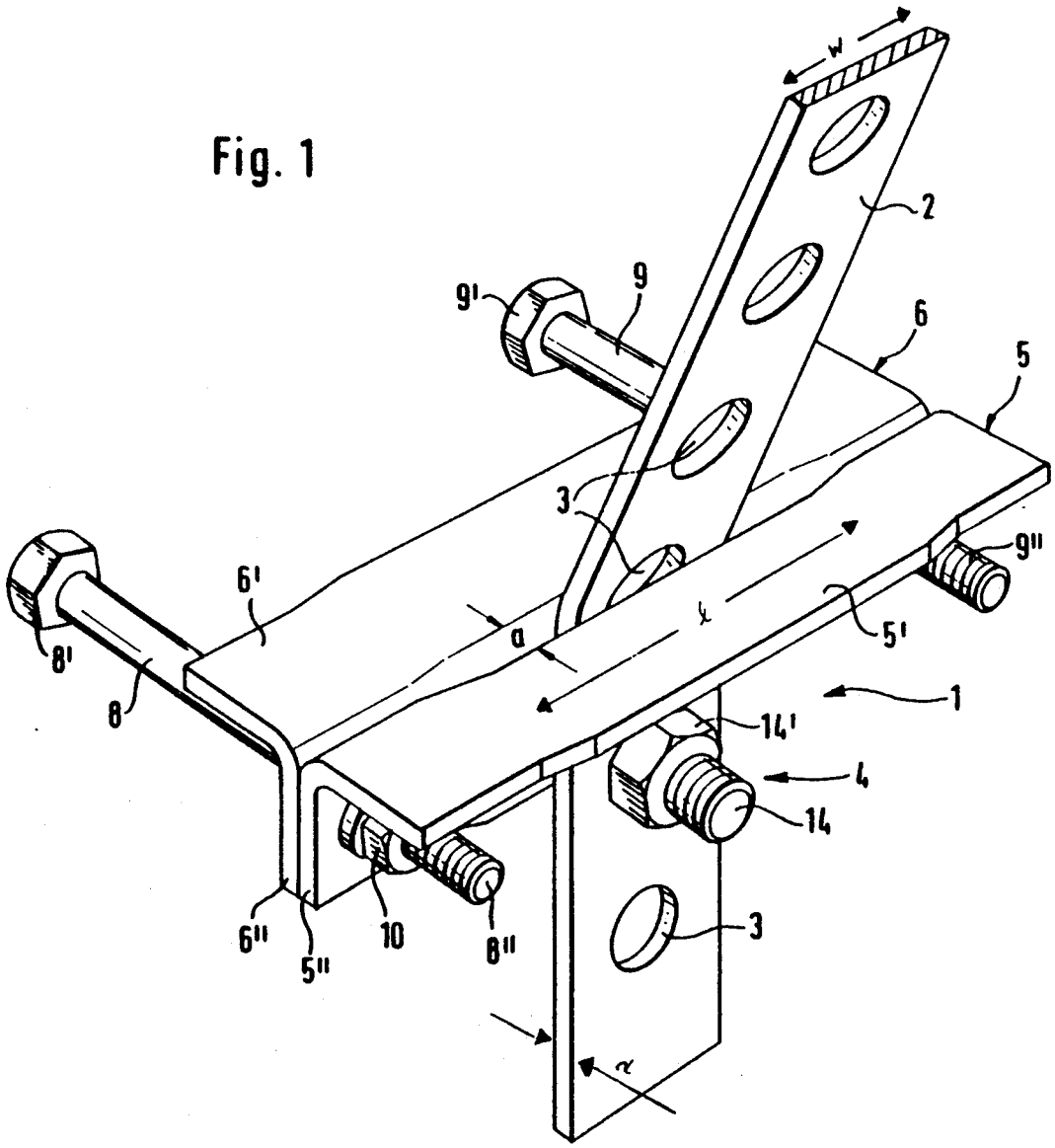
FIG. 1 represents a first embodiment in a perspective view without the cladding panel.

The anchoring device of the present invention is primarily characterized by a fastening element comprising a supporting member and an essentially parallel counter member with the supporting member and the counter member being spaced at a distance over a part of a respective longitudinal dimension of the supporting member and the counter member. The distance corresponds at least to the thickness of a band, that is passed through a space corresponding to the distance between the supporting member and the counter member, whereby a section of the band is bent directly above said supporting member.

The primary advantages of the anchoring device of the present invention are firstly the greatly facilitated mounting of the anchoring device onto the cladding panel and secondly the improved force introduction and distribution in the cladding panel. Since special bending devices are not needed the necessary working time at the installation site is reduced resulting in a facilitated and faster mounting, since the bending step is no longer depending on the working method and skills of the work man.

The anchoring device is further improved such that a simple horizontal sliding of the band relative to the fastening elements of the cladding panel and/or the fastening positions at the construction surface, for example, the building wall, is made possible.

Also, the present invention provides a greatly improved bolt connection of the band over the prior art such that a faster adjustment of the band length is possible and the complicated mounting of the band with the aid of an abutment means for securing the bolt, which requires holding with one hand the abutment means behind the band in the confined space of a recess of the cladding panel, is avoided.

This is achieved with the present invention by providing the band and the bolt in the form of a bayonet locking device whereby the bolt is formlocked by simply being inserted into one of the holes of the band. A further preferred embodiment of this bayonet locking device is to provide the holes of the band with respective cutouts, preferably at the upper edge of the holes and equipping the outer mantle surface of the bolts with at least two projections in the shape of the cutouts of the holes. The projections are arranged one after another in an axial direction of the bolt, whereby the distance between the projections approximately corresponds to the thickness of the band.

In order to ensure an equal distance between the supporting member in the form of an angled piece and the counter piece over the entire desired length, the counter piece is preferably in the form of an essentially planar plate or in the form of an angled piece with its horizontal leg imbedded in the material of the cladding panel. For the secure attachment of the anchoring device in the cladding panel it is expedient to provide the side ends of the angled pieces or the plate with anchoring means for being anchored in the material of the cladding panel. The means may be, for example, in the form of bolts which extend past the side openings of the counter piece. As an alternative, the anchoring means may be in the form of profile irons protruding through the back wall of the cladding panels. They are preferably in the form of U-shaped profile irons. Another embodiment encompasses means in the form of shackles being welded to the inner side of the angled piece which extends into the cladding panel. A further anchoring method is provided in which the ends of the counter piece are bent sideways at an angle. It is also possible to provide a plurality of bent end portions.

In order to improve the force introduction and the force distribution in the cladding panels, it is suggested to pass the bolts through twisted flaps and clamp the flaps between an abutment means and the plate which serves as the counter member. In a further preferred embodiment which ascertains an especially favorable force introduction and distribution in the cladding panel, the counter member comprises a vertical portion that transmutes into an upper portion which is in the form of a semi-circular section extending into the material of the cladding panel. The inner diameter of the semi-circular section is selected such that it tightly engages a reinforcement bar. In order to ascertain the defined distance between the angled piece and the counter member, it is expedient to provide the angled piece and the counter member with two screws and two nuts with which they are connected and clamped together. In a further embodiment, the screws may be in the form of the threaded bolts which also serve as the anchoring device onto which the angled piece is placed and secured by nuts. The space through which the band is passed is defined by the distance between the angled piece and the counter member and may be created by form-pressing at least one of the aforementioned parts or by spacing elements.

The bolt, which is introduced into the hole of the band and onto which the pulling force of the cladding panel acts, may be in the form of a screw and a respective nut which is threaded on to it. In all embodiments, the lower edge of the angled portion and the counter member is resting on the head of the screw and the nut or the cylindrical surface of the bolt. It is advantageous that the anchoring means frictionally engage the reinforcement bars. This prevents or counteracts the generation of cracks in the cladding panels in the area of the anchoring means.

DESCRIPTION OF PREFERRED EMBODIMENTS

The present invention will now be described in detail with the aid of several specific embodiments utilizing FIGS. 1 through 12.

The embodiment of FIG. 1 represents an anchoring device 1, comprising a flat band 2 of an essentially rectangular cross-sectional shape that is provided with spaced holes 3 arranged one after another in a longitudinal direction. A bolt 4 is inserted into one of the holes 3. In this variant, the bolt 4 is formed as a screw 14 with a nut 14'. The band 2 is passed through a supporting member 5 in the form of an angled piece and a second angled piece 6. The angled pieces 5, 6 each have a horizontal leg 5' and 6' and a vertical leg 5" and 6". The horizontal leg 6' of the angled piece 6 is imbedded in the material of a cladding panel 7. Two bolts 8 and 9 that are passed through openings at the opposite ends of the angled pieces 5 and 6 are also imbedded in the material of the cladding panel. They are provided with bolt heads 8' and 9' respectively for a secure anchoring in the cladding panel 7. The angled pieces 5 and 6 are form-pressed such that their vertical legs 5" and 6" are spaced at a distance (a) over a part of their respective longitudinal dimension, but abut at their respective opposite ends where the bolts are passed through. The distance (a) is selected such that it corresponds at least to the thickness (d) of the band 2 in order to be able to slide the band 2 in a vertical direction through the space created by the distance (a) between the vertical legs 5" and 6". The length (1) of that space is selected such that it is longer than the width (w) of the band 2. This permits a horizontal sliding movement of the band 2 between the angled pieces 5 and 6, even when the angled piece 5 is clamped to the angled piece 6 via nuts 10 that are screwed onto the threaded portions 8" and 9" of the bolts 8 and 9. Thereby a horizontal adjustment is easily achieved, even when the cladding panel is already attached, simply by sliding the band 2 sideways in its horizontal direction.

The lower edge of the respective vertical legs 5" and 6" are resting on the screw 14 and the nut 14'. The head of the screw 14 is disposed in a recess 7' provided at the back wall of the cladding panel 7. The band 2, above the angled piece 5, is bent out of its plane that initially is parallel to the cladding panel 7. The angled piece 5 serves as a bending edge for this bending step. A threaded bolt 12 is welded to the upper end of the band 2 which interacts with a fastening part not represented in the drawing. The cladding panel 7 is provided with a reinforcement bar 13 which is looped around the bolts 8 and 9 in a tightly fitting manner. Besides the resulting reinforcement, this arrangement also serves to better distribute the forces acting on the cladding panel 7 and to relieve the bolts 8 and 9.

Figure 2:
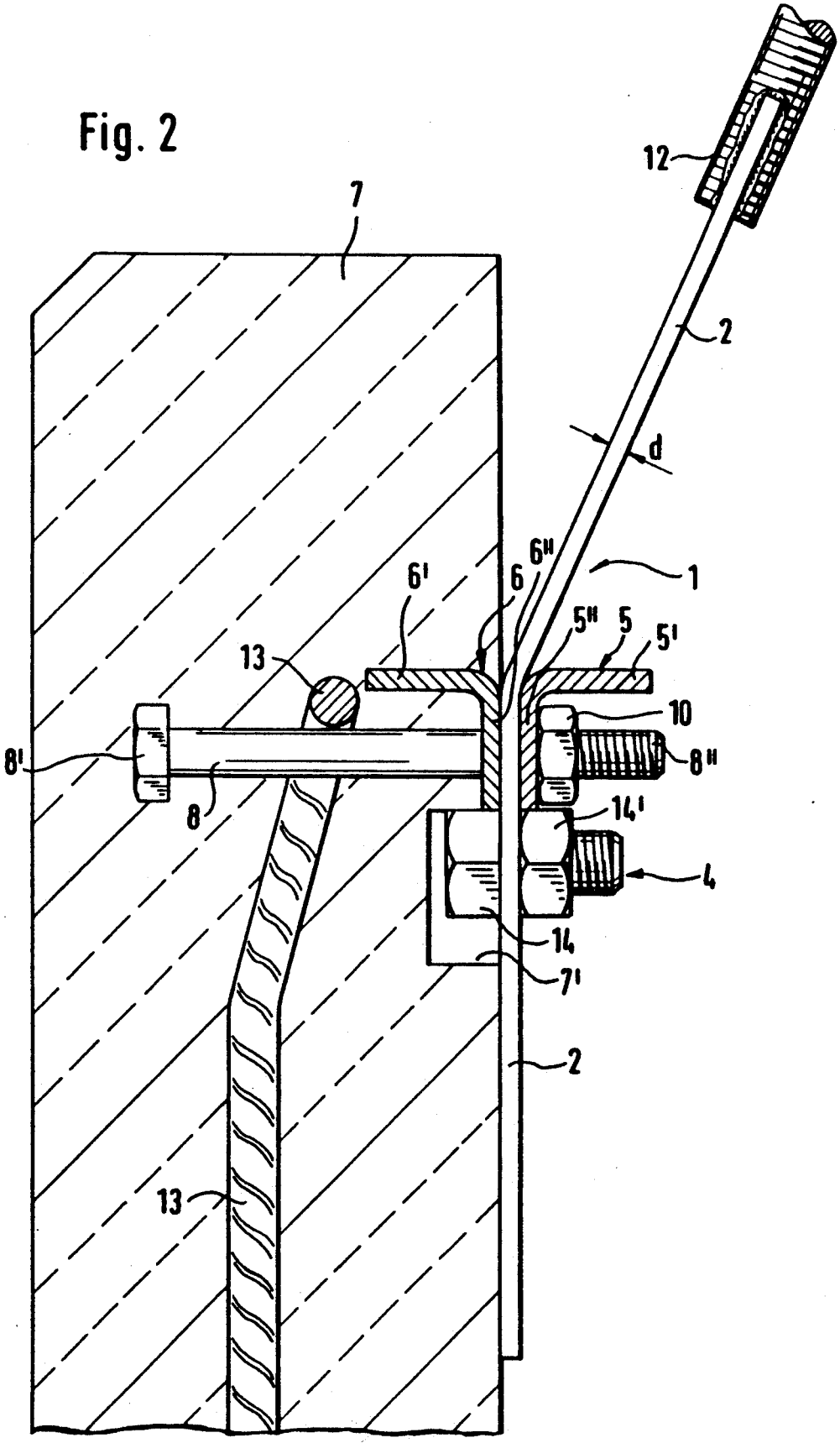
FIG. 2 shows a vertical cross-sectional view of the bolt 8 of a cladding panel with an anchoring device according to FIG. 1.
Figure 3:
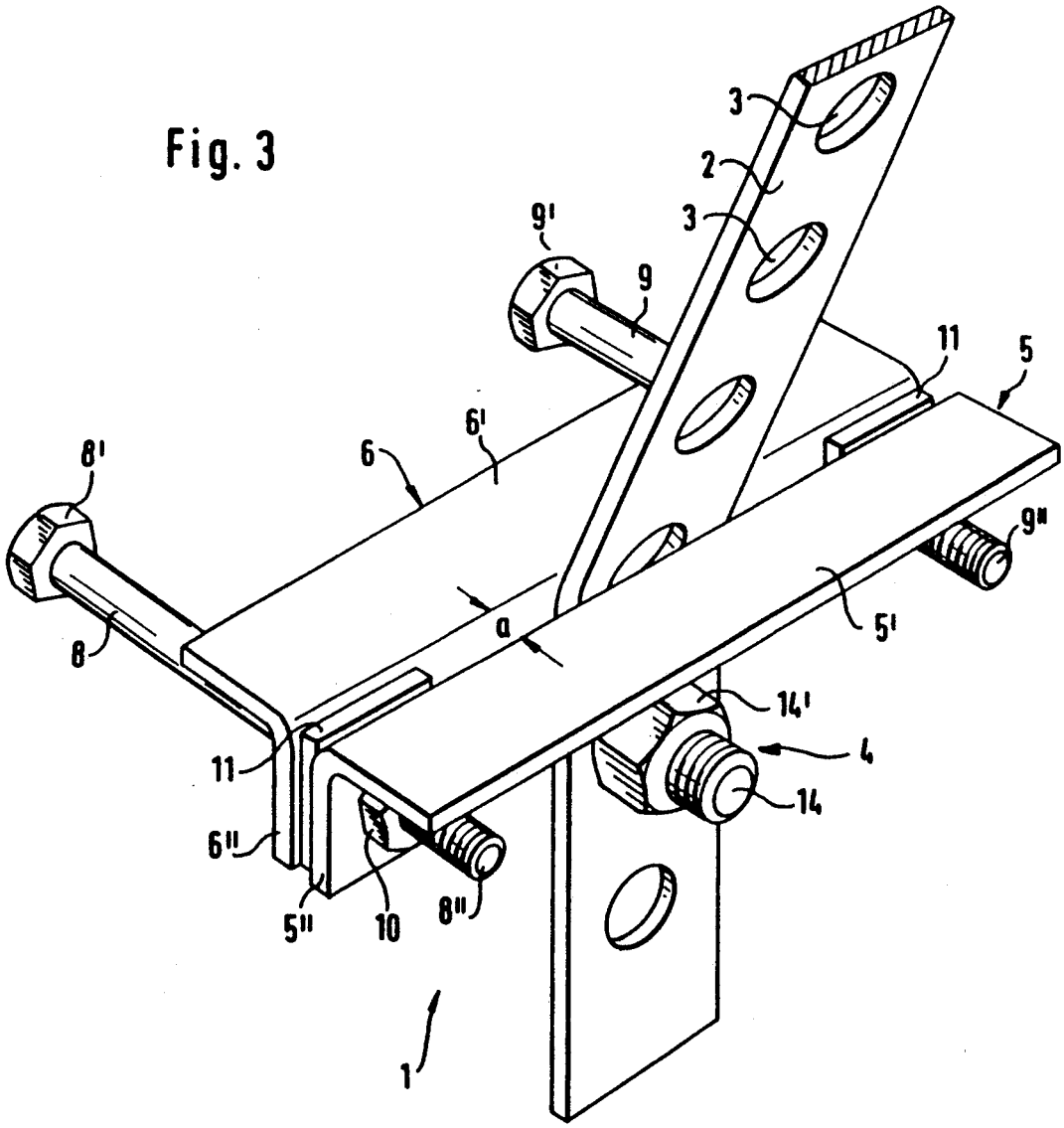
FIG. 3 is a perspective view of a further embodiment of the device of FIG. 1.
Figure 4:
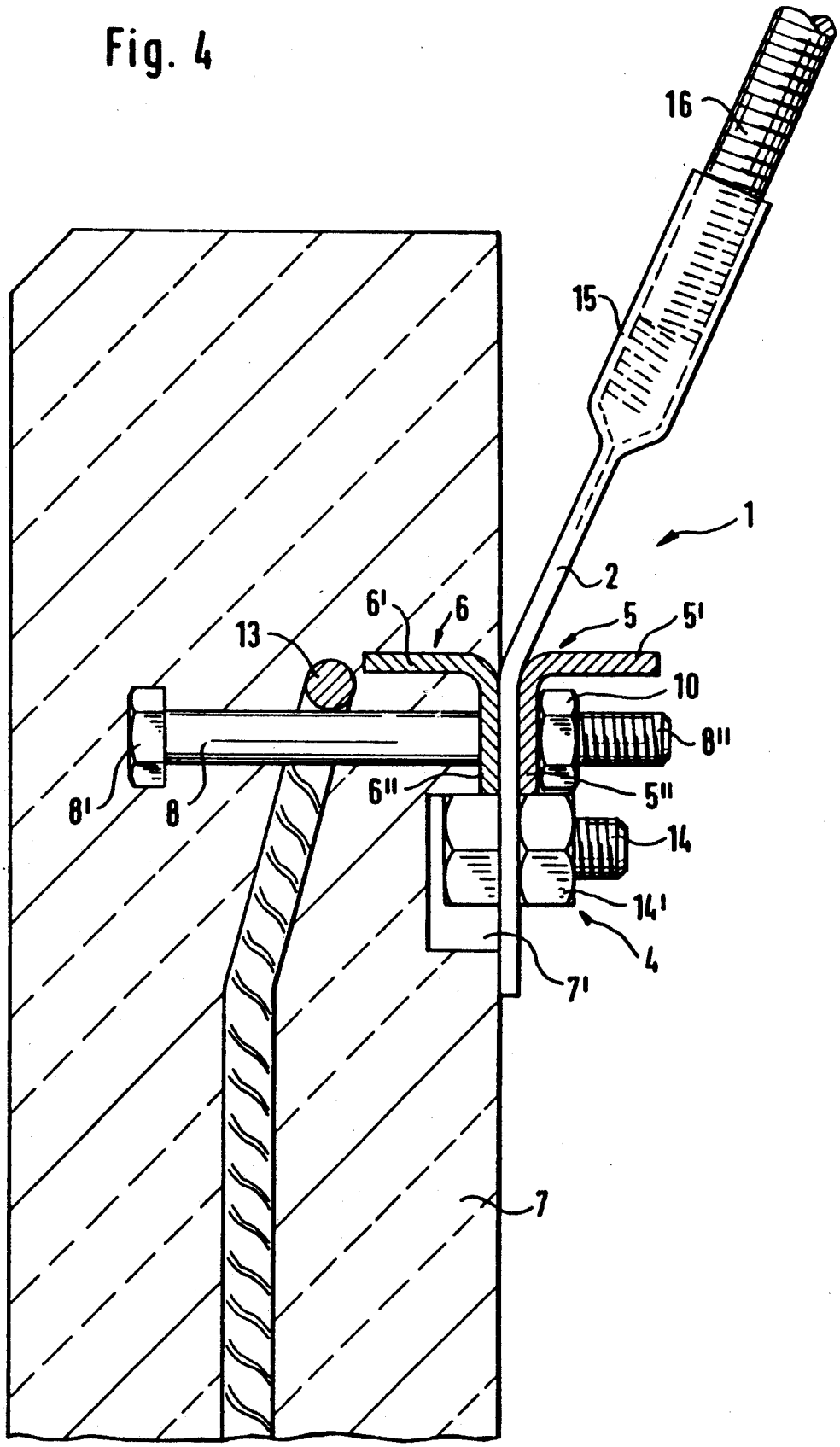
FIGS. 4, 5 show further variants of the embodiment according to FIG. 2.

The embodiment of FIGS. 3 and 4 differs from the one represented in FIGS. 1 and 2 such that between the angled pieces 5 and 6 spacing elements 11 are provided which create the distance (a) between the vertical legs 5" and 6". A form pressing step, as mentioned before for FIG. 1, is therefore not necessary. As can be seen in FIG. 4, the upper end of the band 2 may be formed as a threaded sleeve 15 into which a threaded bolt 16 of a fastening part may be screwed. Numerals in FIGS. 1, 2 and FIGS. 3, 4 are identical when corresponding to the same parts.

Figure 5:
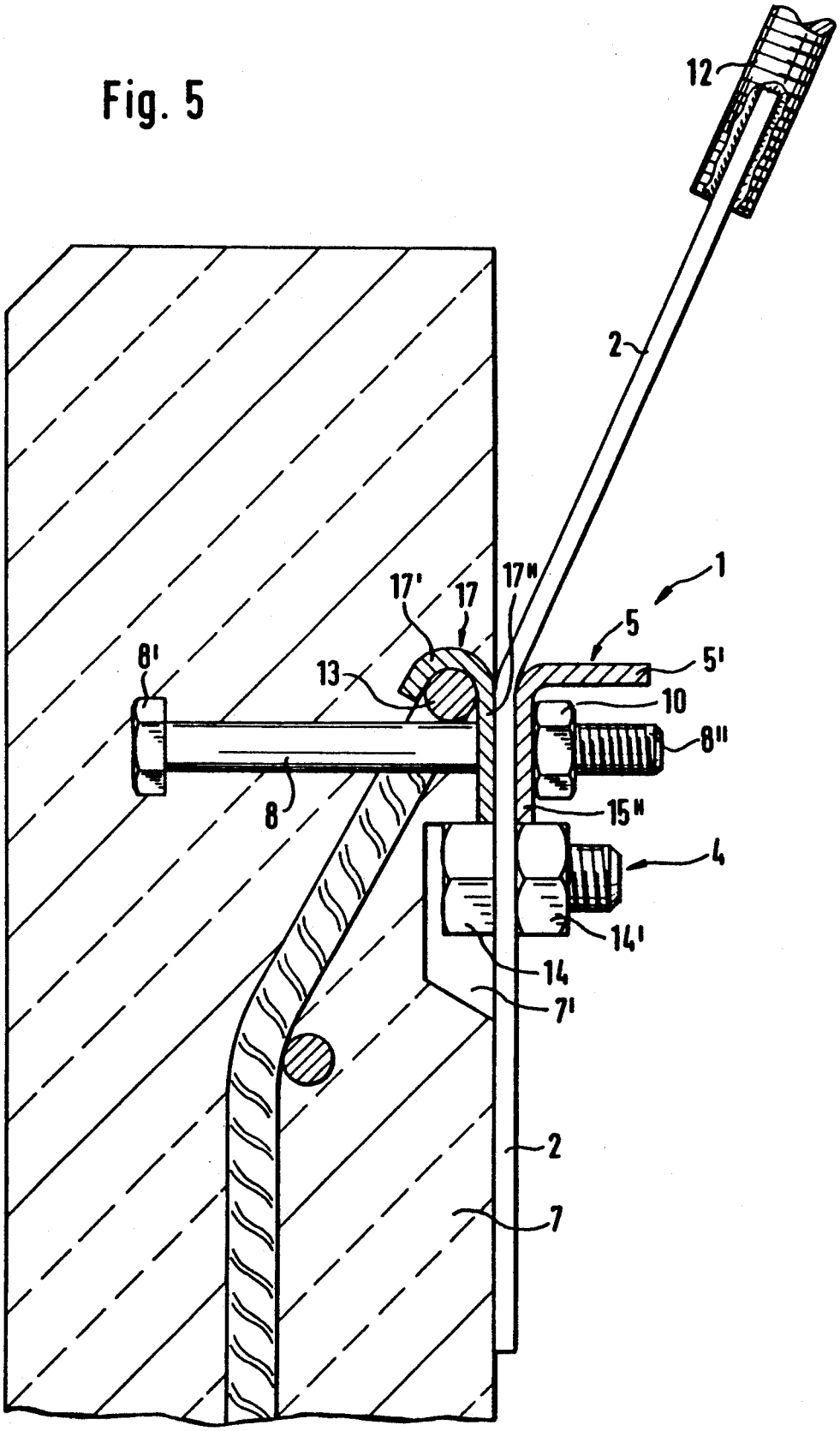

In a further embodiment according to FIG. 5, the angled piece 5 is provided with a counter piece 17 which has a vertical leg 17" extending parallel to the leg 5" of the angled piece 5. An upper portion of the counter piece 17 is bent to form a semi-circular portion 17' which extends into the material of the cladding panel 7. The inner diameter of the semi-circular portion 17' is selected such that the portion 17' tightly engages the reinforcement bar 13.

When mounting the embodiments of FIGS. 1 through 5, the screw 14 is inserted into one of the holes 3 of the band 2, that corresponds to the desired length of the anchoring device 1, and the nut 14' is screwed onto the screw. The band 2 is then arranged between the angled pieces 5 and 6 or the counter piece 17 such that the lower edge of the vertical legs 5" and 6" or 17" are resting on the head of the screw 14 and the nut 14'. The angled pieces 5 and 6 or the counter piece 17" are then brought into contact via the nuts 10 on the threaded sections 8" and 9" of the bolts 8 and 9, whereby spacing elements 11 are used, if necessary. The vertical legs 5" and 6" or 17" are spaced at the desired distance (a) so that by pulling the band 2 in an upward direction the contact of the screw 14 and the nut 14' at the angled pieces 5 and 6 is ensured. The band 2 is entirely flat up to this point. The upper portion of the band 2 is subsequently bent away from the cladding panel 7 by using the angled piece 5 as a bending edge.

When loading the anchoring device 1 with the suspended cladding panel 7, a pulling force is generated in the band 2 because the weight of the cladding panel 7 is transferred via the bolts 8 and 9 to the angled pieces 5 and 6 which are resting on the screw 14 and the nut 14'. In the embodiment according to FIG. 5, the bolts 8 and 9 are relieved due to the frictional connection of the counter piece 17 and the reinforcement bar 13.

Figures 6A, 6B, 6C:
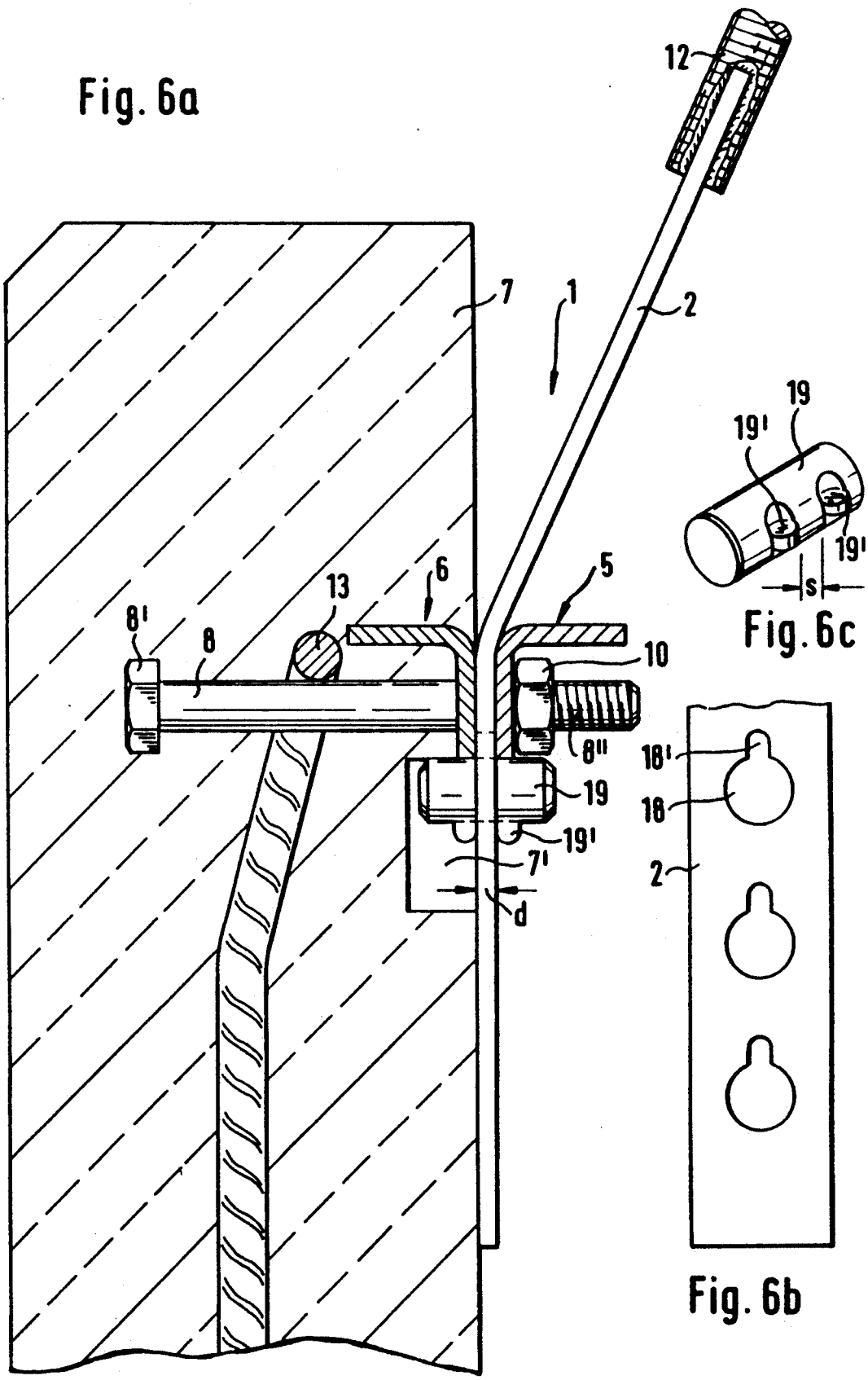
FIGS. 6*a–c* show an embodiment of the anchoring device with a bayonet-type locking of the bolt.

The embodiment of FIG. 6*a* through 6*c* shows an inventive anchoring device 1 in which the band 2 and the bolt 19 are designed as a bayonet locking device, in which the bolt 19 is formlocked when inserted into the hole 18 of the band 2. In the shown example the band 2 is equipped with holes 18 having at their upper end a cutout 18', as may be seen in FIG. 6*b*.

An essentially cylindrical bolt 19 is inserted into the hole 18 of the band 2. On the outer mantle surface the bolt 19 is equipped with two projections 19' which are arranged one after another in an axial direction of the bolt 19 (cf. FIG. 6*c*). The distance (s) between the two projections corresponds to the thickness (d) of the band 2. All the other parts are identical to the parts in the FIG. 2 and have therefore the same numerals.

The mounting of the anchoring device 12 represented in FIG. 6 is easier and faster than for the arrangement with the screw 14 and the nut 14'. The angled piece 5 may already be clamped against the angled piece 6 when the band 2 is inserted into the space between the angled pieces 5 and 6. According to the desired length of the anchoring device 1, the bolt 19 is inserted into one of the holes 18 such that a projection 19' slides through the cutout 18'. Then the bolt 19 is rotated, for example, 180° about its longitudinal axis (cf. representation in FIG. 6*a*). Since the band 2 is pulled upward and is then bent above the angled piece 5 the cutout 18' is now located between the vertical legs of the angled piece 5 and 6 so that an accidental unlocking of the bolt 19 is prevented. The inventive bayonet locking device, in comparison with a screw and nut assembly, is easier to mount and allows for a faster adjustment of the length of the band 2 during the mounting step because the thread-less bolt is only to be inserted and locked by rotating it into its locking position. This embodiment has also the advantage that the recess 7' in the cladding panel 7 may be designed smaller because a further countering means, for example, a threaded nut, is not necessary and the space that has to be provided for reaching and holding the nut during the mounting step is unneeded. Since the space requirements for the recess 7' may be kept at a minimum, the spacial arrangement of the reinforcement bars for reinforcement purposes, which is necessary in most cases, is not negatively affected. Also, the production of the bayonet locking device does not require expensive cutting and machining steps such as the cutting of a thread, so that the bayonet locking device, the producing and the mounting steps included, is simpler and less expensive.

Figure 8:
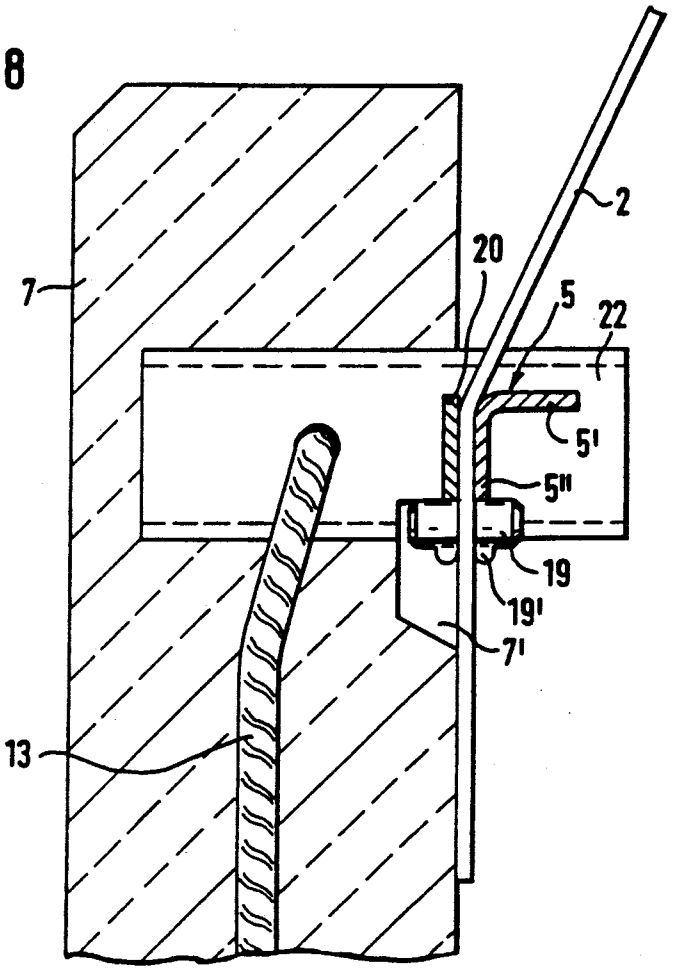
FIG. 8 is a vertical cross-sectional view of a cladding panel with an anchoring device according to FIG. 7.
Figure 7:
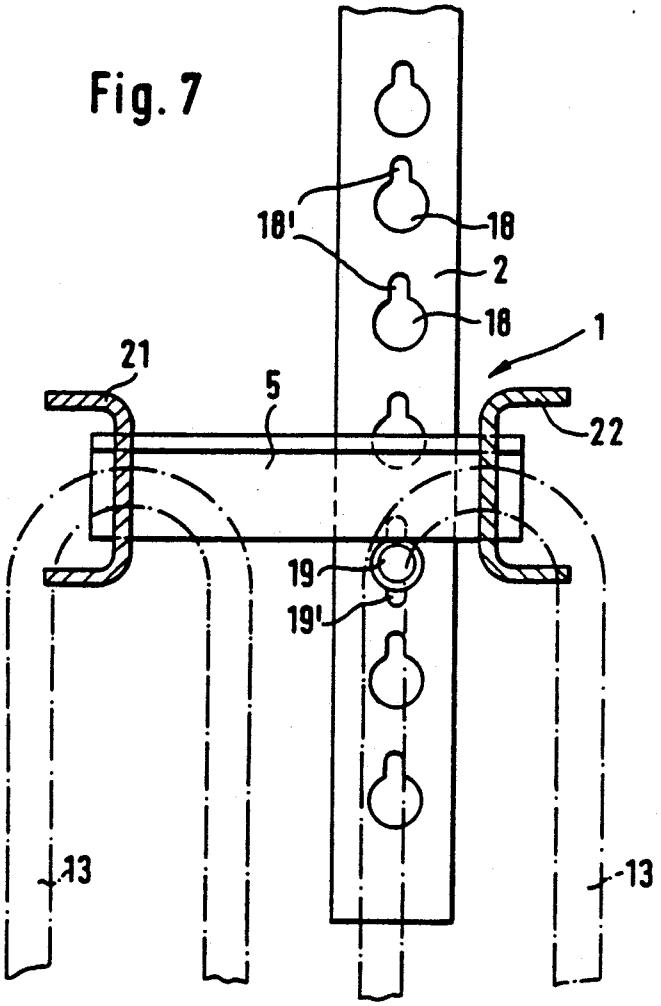
FIG. 7 shows the supporting member and the counter member formed as angled pieces and supported by profile irons.

FIGS. 7 and 8 show an anchoring device 1 in which the sides of the angled piece 5 and the counter piece which is formed as a plate 20 are supported by two profile irons 21 and 22. For this purpose the U-shaped profile irons 21 and 22 each have an opening which corresponds to the cross-section of the angled piece 5 and the plate 20. It can be seen in FIG. 8, that the profile irons 21 and 22 are imbedded in the material of the cladding panel 7, whereby they are additionally secured by the reinforcement bars 13. They protrude slightly from the back of the cladding panel 7. Between the angled piece 5 and the plate 20, the band 2 is passed through, which is also equipped with holes 18 and respective cutouts 18', as shown in FIGS. 6*a*–6*c*, and is fastened via a bolt 19. As described before, the bending of the upper portion of the band 2 is also carried out with the aid of the angled piece 5 serving as a bending edge. The band 2 may horizontally slide between the two profile irons 21 and 22 over the entire length.

Figure 9:
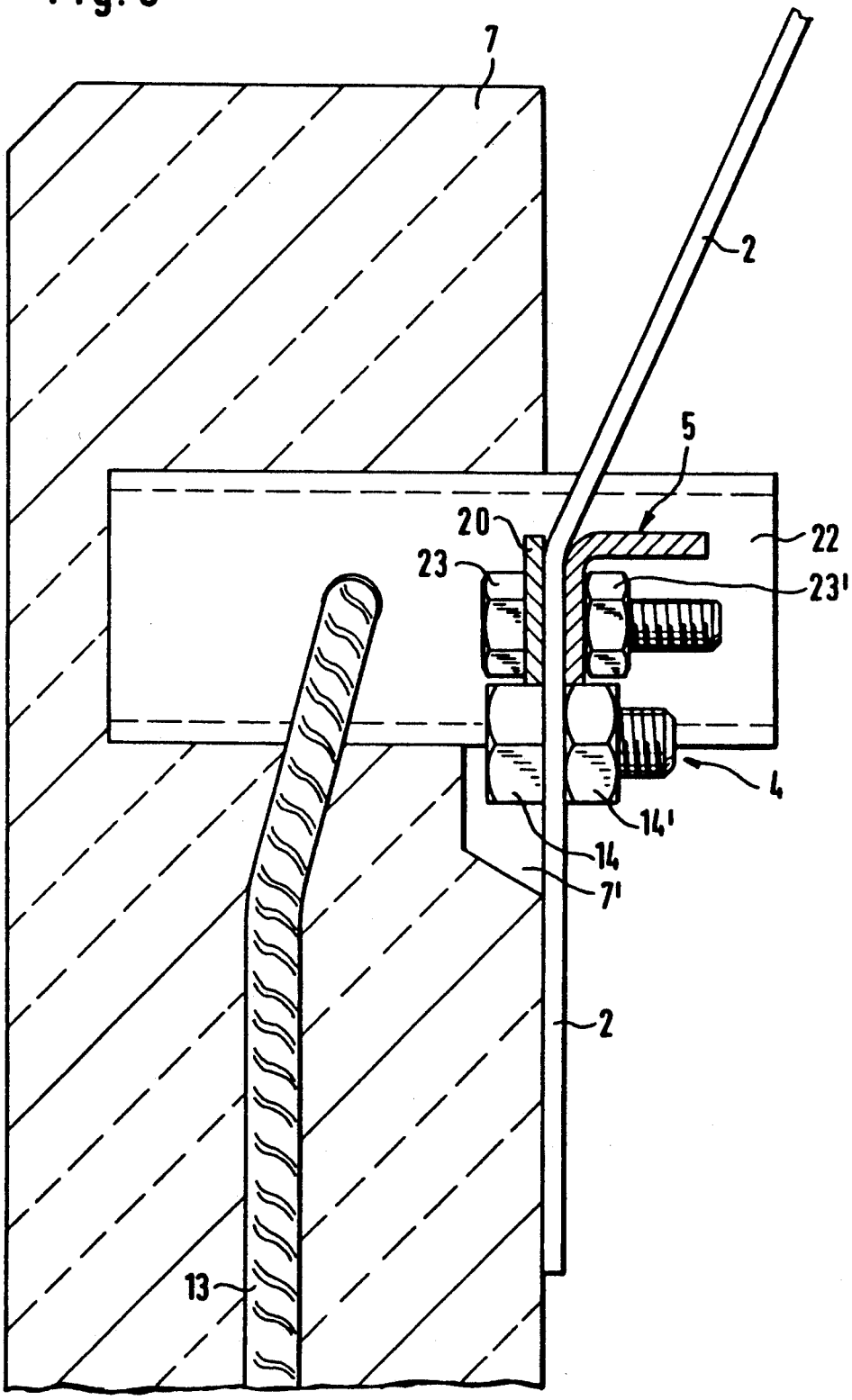
FIG. 9 shows a variant of the embodiment of FIG. 8.

In FIG. 9 another variant of the embodiment of FIG. 8 is shown, in which the band, as in FIGS. 1–5, is equipped with holes 3. A screw 14 is inserted into one of the holes 3. The screw head is positioned in the recess 7' of the cladding panel 7, while a nut 14' is screwed onto the other end. The angled piece 5 and the plate 20 are clampable against each other via screws 23 and nuts 23' which are guided through openings located close to the ends of the angled piece 5 and the plate 20. Of course, a space between the angled piece 5 and the plate 20 is maintained in order to allow the horizontal sliding of the band 2.

Figure 10:
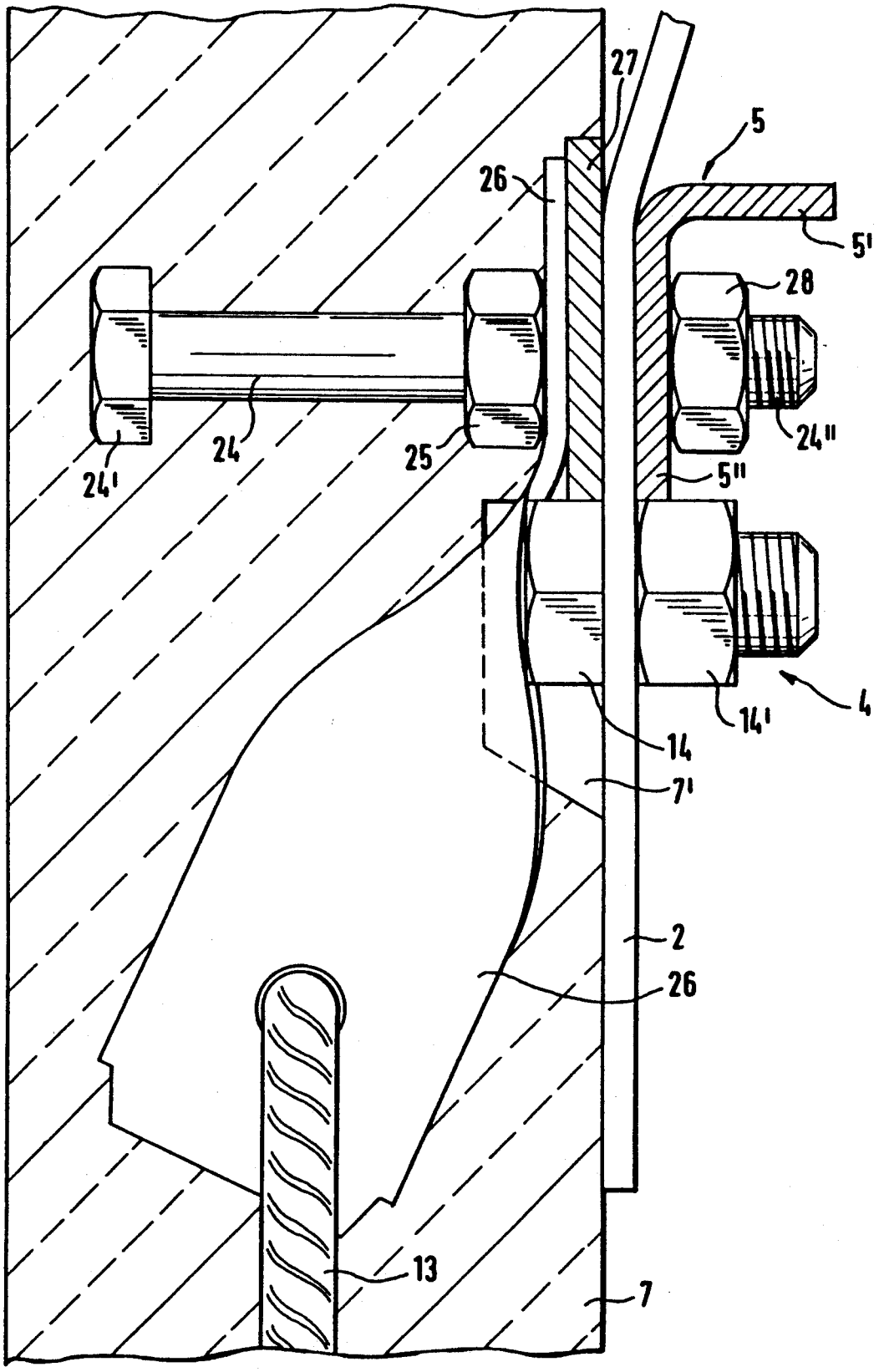
FIG. 10 shows an embodiment of the anchoring device with a different force distribution onto the reinforcement bar of the cladding panel.

Another embodiment according to FIG. 10 shows an anchoring device 1 for the cladding panel 7 in which a threaded bolt 24 with a screw head 24', a nut 25 which is threaded onto the bolt 14 and which serves as an abutment means, and a twisted flap 26 resting on the nut 25 are imbedded in the cladding panel 7. The flap 26 is provided with an opening which engages a reinforcement bar 13. A plate 27 is placed onto the bolt 14 thereby forming the counter piece for the angled piece 5 and clamping the flap 26 between itself and the nut 25. Onto the free end 24'' of the threaded bolt 24 a nut 28 is threaded which is clamping the angled piece 5 against the plate 27 while, of course, maintaining the distance between them in order to ensure the horizontal sliding of the band 2. A screw 14 is inserted in the band 2 and a nut 14' is threaded onto the screw 14. In the aforementioned manner the lower edges of the plate 27 and the angled piece 5 are resting on the screw head 14 and the nut 14'.

Figure 11:
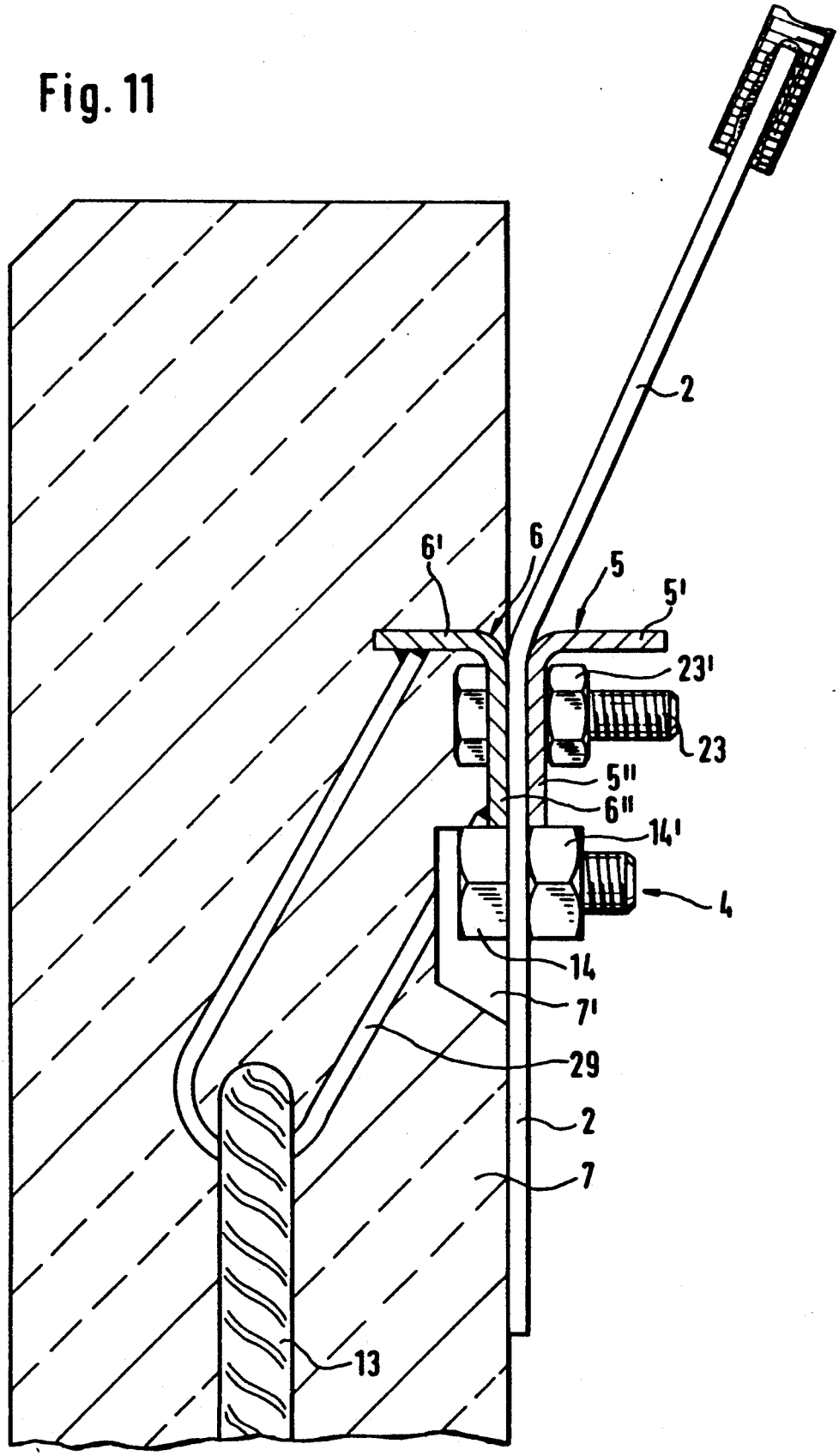
FIG. 11 represents a variant of the embodiment of FIG. 10.

In the embodiment of FIG. 11 the band 2 is passed through between the angled pieces 5 and 6 and is provided with a screw 14 and a nut 14' on which the angled pieces 5 and 6 are resting. Hair pin-like shackles 29 are welded to the inner side of the angled portions 6 which are extending downward at an angle and are engaging reinforcement bars 13. In order to clamp the angled piece 5 against the angled piece 6, the screws 26 and the nuts 26' are provided at the sides of the angled pieces 5 and 6.

Figure 12:
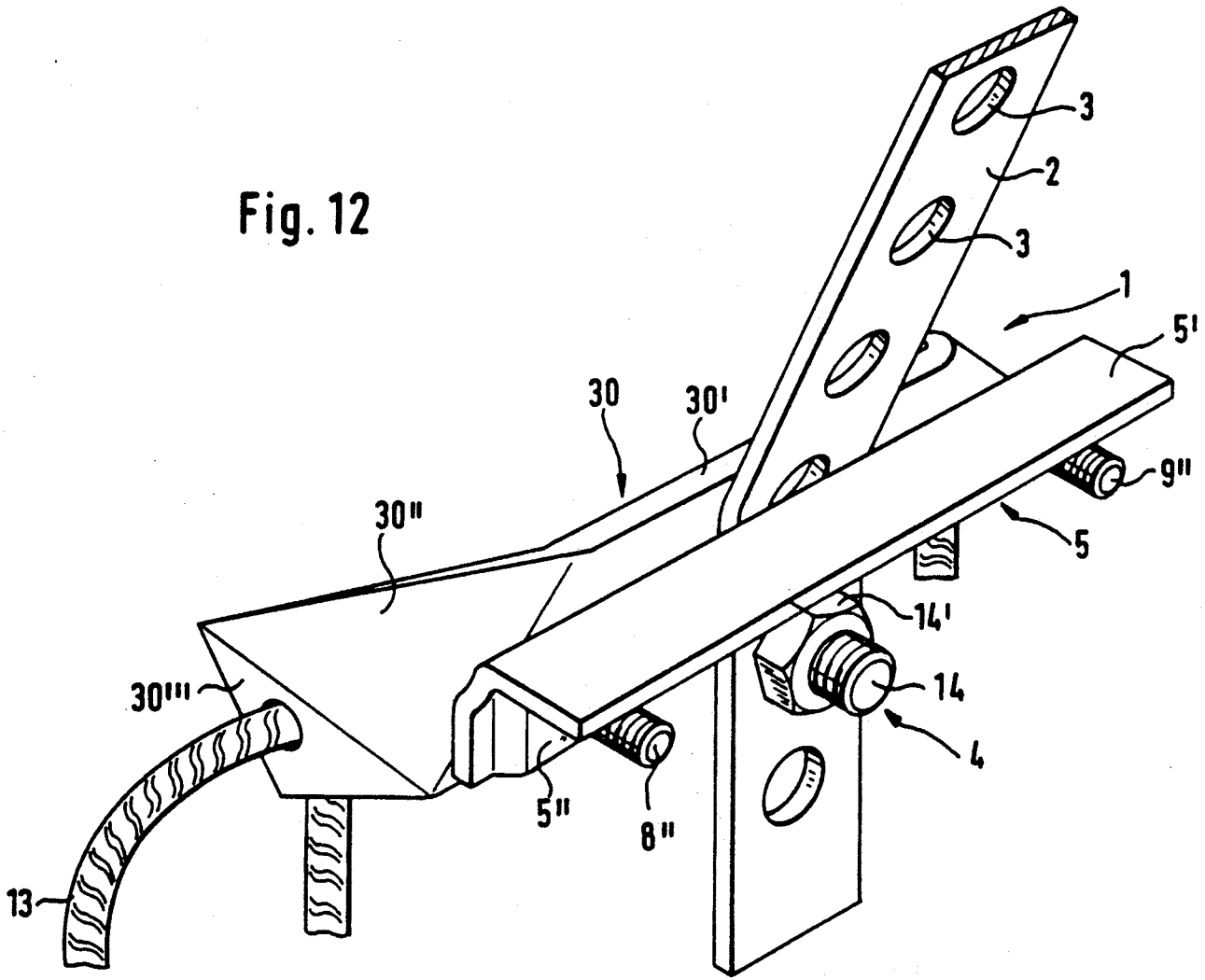
FIG. 12 is a perspective view of an anchoring device with the ends of the counter member being bent.

FIG. 12 represents an anchoring device 1 with a band 2 that is passed through between an angled piece 5 and a counter piece 30. The middle section of the counter piece 30 is equipped with a planar portion 30'. Each of the side sections 30'' is bent twice at an angle of 45°. Through the outer bent edge 30''' a reinforcement 13 bar is passed. The arrangement of the clamping means and the bolts is the same as in the embodiments described above.

All the aforementioned embodiments are provided with a supporting member 5 preferably in the form of an angled piece which, due to its shape, is sufficiently bending resistant to exactly maintain its shape during the bending step of the band 2. The band may be bent by hand without any further auxiliary means, because, even for extremely heavy cladding panels, the thickness of the cladding panels usually does not exceed approximately 4 mm.

The present invention is, of course, in no way restricted to the specific disclosure of the specification, examples and drawings, but also encompasses any modifications within the scope of the appended claims.

What I claim is:

1. In an anchoring device for fastening cladding panels to a wall, said anchoring device comprising a flat band of a rectangular cross-section that is provided with spaced holes arranged one after another in a longitudinal direction, and with an upper end and thereof being connected to a fastening part, with a first bolt being inserted into one of said holes for fastening said band to a fastening element that is to be connected to said cladding panel, the improvement wherein:

said fastening element comprises a supporting member and an essentially parallel counter member, with said supporting member and said counter member being spaced from one another at a distance over at least a portion of a respective longitudinal dimension of said supporting member and said counter member, with said distance corresponding at least to a thickness of said band, with said band being passed through a space corresponding to said distance and with a section of said band being bendable directly above said supporting member; and said supporting member is formed as a first angled piece having a respective essentially horizontal leg and a respective essentially vertical leg having a recess corresponding to said distance and extending over a portion of said longitudinal dimension of said supporting member.

2. An anchoring device according to claim 1, in which said portion in said longitudinal dimension is greater than a width of said band so that said band is slidable in the direction of said width.

3. An anchoring device according to claim 1, in which said counter member is formed as a planar plate.

4. An anchoring device according to claim 3, in which said planar plate, at ends thereof in a longitudinal direction, is equipped with fastening means.

5. An anchoring device according to claim 4, in which said counter member has openings and said fastening means are in the form of second bolts that extend through said openings of said counter member, said openings being arranged at ends of said counter member in a longitudinal direction thereof.

6. An anchoring device according to claim 5, in which said bolts have a threaded portion onto which said supporting member is placed and fastened via nuts.

7. An anchoring device according to claim 5, further comprising twisted flaps through which said second bolts are passed, with said flaps being clamped between said planar plate and an abutment provided at said second bolts.

8. An anchoring device according to claim 4, in which said fastening means are in the form of profile irons extending from a back side of said cladding panels.

9. An anchoring device according to claim 8, in which said profile irons are U-shaped.

10. An anchoring device according to claim 4, further comprising reinforcement bars disposed in said panel, said fastening means engaging in a formlocking manner said reinforcement bars.

11. An anchoring device according to claim 5, in which said fastening means are formed as bent edges of said counter member.

12. An anchoring device according to claim 1, in which said counter member is formed as a second angled piece having a second essentially horizontal leg that is imbedded into the material of said cladding panel.

13. An anchoring device according to claim 12, in which said angled piece, at ends thereof in a longitudinal direction, is equipped with fastening means.

14. An anchoring device according to claim 13, in which said fastening means are in the form of third bolts that extend through openings of said counter member, said openings being arranged at ends of said counter member in a longitudinal direction thereof.

15. An anchoring device according to claim 14, in which said bolts have threaded portions onto which said supporting member is placed and fastened via nuts.

16. An anchoring device according to claim 13, in which said fastening means are in the form of shackles that are welded to said angled pieces.

17. An anchoring device according to claim 13, in which said fastening means are engaged in a formlocking manner by reinforcement bars.

18. An anchoring device according to claim 1, in which said counter member has a vertical section that, at an upper end thereof, transmutes into a semi-circular section, an inner diameter of which is selected such that said semi-circular section engages a reinforcement bar in a tight fit.

19. An anchoring device according to claim 1, in which said supporting member and said counter member are connectable and clampable to one another via two screws and respective nuts.

20. An anchoring device according to claim 19, in which said screws are in the form of threaded portions of said bolts, onto which threaded portions said supporting member is placed and fastened via nuts.

21. An anchoring device according to claim 1, in which said distance that creates a space between said supporting member and said counter member, through which space said band is passed, is formed by recesses in at least one of said supporting and counter members.

22. An anchoring device according to claim 1, in which said distance is created by spacing elements.

23. An anchoring device according to claim 1, in which said first bolts, extending through said holes of said band, are in the form of screws having a nut fastened thereto.

24. An anchoring device according to claim 23, in which a respective lower edge of said supporting member and said counter member are resting on top of said screw and said nut.

25. An anchoring device according to claim 1, in which said band and said first bolts interact in the form of a bayonet locking device such that said first bolt, when inserted into one of said holes of said band, is formlocked.

26. An anchoring device according to claim 25, in which said holes of said band have cutouts and said bolts, on an outer mantle surface thereof, are provided with at least two respective projections, with said projections being arranged, spaced at a distance from one another, in an axial direction of said bolt, with said distance corresponding approximately to said thickness of said band.

27. An anchoring device according to claim 26, in which said cutouts are on upper edges of said holes.

28. An anchoring device according to claim 25, in which a respective lower edge of said supporting member and said counter member are resting on top of a cylinder surface of said bolt.

29. In an anchoring device for fastening cladding panels to a wall, said anchoring device comprising a flat band of a rectangular cross-section that is provided with spaced holes arranged one after another in a longitudinal direction, and with an upper end thereof being connected to a fastening part, with a first bolt being inserted into one of said holes for fastening said band to a fastening element that is to be connected to said cladding panel, the improvement wherein:

said band and said first bolts interact in the form of a bayonet locking device such that said first bolt, when inserted into one of said holes of said band, is formlocked.

* * * * *